United States Patent [19]

Fujita et al.

[11] 4,030,987

[45] June 21, 1977

[54] ZINC PLATING METHOD

[75] Inventors: Shigeru Fujita, Omiya; Koichi Murayama, Tokyo; Toyohito Kaneda, Yono, all of Japan

[73] Assignee: Kabushiki Kaisha Japan Metal Finishing Company, Tokyo, Japan

[22] Filed: Mar. 4, 1976

[21] Appl. No.: 663,695

[30] Foreign Application Priority Data

Mar. 8, 1975 Japan ..... 50-28191

[52] U.S. Cl. ..... 204/55 R

[51] Int. Cl.[2] ..... C25D 3/22

[58] Field of Search ..... 204/55 R, 55 Y, 43 Z, 204/114

[56] References Cited

UNITED STATES PATENTS 3,974,045 8/1976 Takahashi et al. ..... 204/55 R

*Primary Examiner*—G. L. Kaplan

[57] ABSTRACT

An article is zinc plated by electrodeposition in an alkaline zinc plating bath of ZnO and NaOH to which has been added, together with a small quantity of an aromatic aldehyde, a polyamine sulfone represented by the formula where:

each of $R_1$ and $R_2$ is hydrogen, an allyl group, a straight-chain or branched-chain alkyl group having 1 to 16 carbon atoms, an aralkyl group, or a hydroxyalkyl group of the general formula $HO\text{-}(CH_2)_m$, where $m$ is an integer of 1 to 6;

$X^-$ is a halogen ion, $HSO_4^-$, $HSO_3^-$, $HCOO^-$, or $CH_3COO^-$; and $n$ is an integer such that the number average molecular weight becomes 2,000 to 350,000.

$a$ and $b$ are natural numbers having a relation such that $a:b = 100$; (10 to 100).

6 Claims, 8 Drawing Figures

ZINC PLATING METHOD

BACKGROUND OF THE INVENTION

This invention relates generally to zinc plating techniques and more particularly to a method of carrying out zinc plating with the use of a plating bath capable of forming excellent plated surfaces without the use of cyanic compounds.

The zinc electroplating methods practiced heretofore may be divided broadly into alkaline type plating methods in which cyanic compounds are principally used and acidic type plating methods in which zinc chloride, zinc sulfide, and the like are used. Of these, the zinc plating method most widely practiced at present is a strongly alkaline type plating method using a plating bath containing a cyanic compound, particularly a large quantity of sodium cyanide, and a soluble zinc compound.

Since sodium cyanide is contained in large quantity in the plating bath according to this strongly alkaline type plating method, it is possible thereby to obtain a zinc plated surface which is smooth and nearly semi-bright. It is also known that the finish of this plated surface can be made even better by adding to the plating bath a minute quantity of a brightener by itself or together with other constituents. Examples of suitable brighteners are gelatine, peptone, sodium sulfide, thiourea, polyvinyl alcohol, aldehydes, ketones, and salts of organic acids.

However, since a large quantity of cyanic compounds, which are toxic substances, are used in this alkaline type plating method, the resulting waste liquid cannot be discharged as it is since there is a high risk of this liquid causing pollution. Accordingly, it is necessary to treat the waste liquid by means of expensive equipment, which is not desirable for economical operation. Furthermore, this method gives rise to an undesirable working environment in the plating operation. For example, in the process of zinc plating an iron (steel) base material, iron dissolves in large quantity into the plating bath thereby forming ferrocyanic complex salts or ferricyanic complex salts. Since these complex salts are highly stable, they do not readily decompose into free cyanogen and cannot be completely decomposed and treated by a two-stage treatment by the conventional alkaline chlorine method.

For this reason, alkaline type zinc plating without the use of cyanic compounds is beginning to attract interest, and a typical technique involves the use of a plating bath containing sodium zincate and excess sodium hydroxide is used. When zinc plating is carried out with this plating bath, a spongy zinc without brightness is precipitated, and only a very poor plated surface can be formed. For this reason, efforts are being made to form good plated surfaces by adding brighteners to this plating bath.

Examples of these brighteners are salts of glycollic acid, alkanolamine, ethylenediamine, diethylenetriamine, triethylenetetramine, tetraethylenepentamine, and other alkyleneamines. The use of a brightener of this kind by itself or together with an aromatic aldehyde is also known. However, even by adding such an alkyleneamine brightener to the above mentioned plating bath, it is difficult to form a uniform and homogeneous plated surface. In addition, since the plating conditions for forming a plated surface of good brightness are exact and strict, the utilization of this method is practically impossible for industrial purposes.

Furthermore, it has been found that the product formed from an amine-epoxy reaction is effective as a brightener for an alkaline type plating bath containing a cyanic compound. This brightener comprises principally the reaction product of epichlorohydrin and various amines. For example, in U.S. Pat. No. 2,860,089, a reaction product of epichlorohydrin and ammonia or ethylenediamine is called a polyepoxyamine and is described. Furthermore, a reaction product of epichlorohydrin and hexamine is disclosed in U.S. Pat. No. 3,227,683.

These brighteners exhibit considerable effectiveness in plating baths contain cyanic compounds since the epoxy ring reacts with water, whereby two OH radicals are formed, and, moreover, the chlorine of the epichlorohydrin reacts with $NH_2$ to become a quaternary ammonium salt. Attempts have been made to improve brightness by adding brightness of this character into plating baths which do not contain cyanic compounds.

However, since the plating film hardness is high, peeling off of the plated surface frequently occurs during working of the plated material, whereby this improvement of brightness cannot be said to be satisfactory, and, moreover, the rate of plating film deposition is slow. For this reason, while this practice is possible on a laboratory scale, it is not suitable for quantity (mass) production on an industrial scale. Furthermore, in comparison with the case of plating with the use of a plating bath containing a cyanic compound, it is more difficult to form a uniform surface, and, moreover, it is difficult to obtain a bright finish on a plated surface electrodeposited by a low current. These adverse features of this practice indicate that it is not suitable for a rack type plating operation.

SUMMARY OF THE INVENTION

It is a general object of this invention to overcome the above described difficulties encountered in the prior art.

More specifically, an object of the invention is to provide a plating bath affording uniform electrodeposition, brightness range, and stability which are respectively equal to or superior to those attained when plating is carried out with a plating bath containing a cyanic compound, that is, to provide a method of carrying out plating in a plating bath containing a novel brightener.

In accordance with this invention, briefly summarized, there is provided a zinc plating method characterized in that electrodeposition is carried out in an alkaline zinc plating bath to which has been added, together with an aromatic aldehyde, a polyamine sulfone represented by the formula

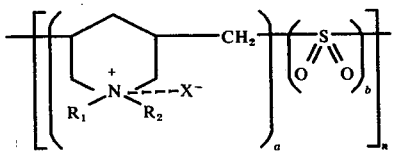

where:

each of $R_1$ and $R_2$ is hydrogen, an alkyl group, a straight-chain or branched-chain alkyl group having 1 to 16 carbon atoms, an aralkyl group, or a hydroxyalkyl group of the general formula $HO\text{-}(CH_2)_m$, where $m$ is an integer of 1 to 6;

$X^-$ is a halogen ion, $HSO_4^-$, $HSO_3^-$, $HCOO^-$, or $CH_3COO^-$;

$n$ is an integer such that the number average molecular weight becomes 2,000 to 350,000, and, $a$ and $b$ are natural numbers having a relation such that $a : b = 100$: 10 to 100.

We have found that, by the practice of the zinc plating method according to this invention, it is possible to form a plated surface having a brightness and smoothness equal or superior to those of a plated surface formed by plating in a plating bath containing a cyanic compound. Furthermore, the deposition rate of the plating film in the method of this invention is also good. A further advantageous feature of this method is that, since a cyanic compound is not used, expensive equipment for treatment of waste liquid is not necessary, and the method does not entail a hazardous work environment and pollution.

The nature, utility, and further features of the invention will be apparent from the following detailed description beginning with a consideration of general features and concluding with specific examples of practice illustrating preferred embodiments of the invention when read in conjunction with the accompanying drawings.

DETAILED DESCRIPTION

Figure 1:
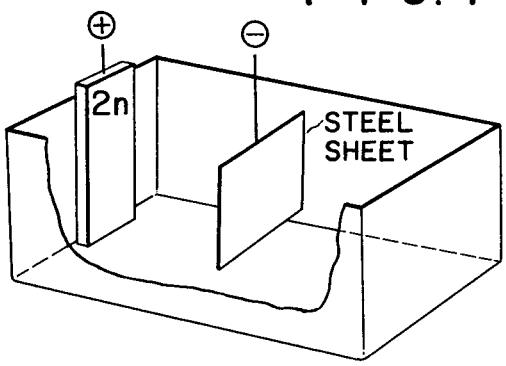
FIG. 1 is a diagrammatic perspective view, with a part cut away, showing the essential structure of an example of a plating vessel for carrying out the zinc plating method of the invention.

The polyamine sulfone used in the method of this invention is a water-soluble, cationic, high-polymer compound produced as follows:

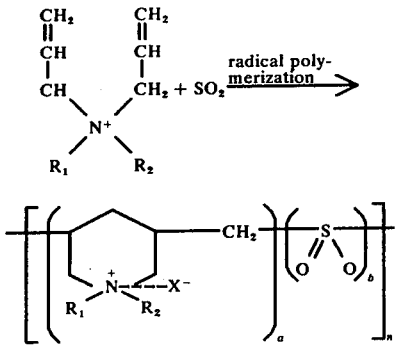

where:

each of $R_1$ and $R_2$ is hydrogen, an allyl group, a straight-chain or branched-chain alkyl group having 1 to 16 carbon atoms, an aralkyl group, or a hydroxyalkyl group of the formula $HO\text{-}(CH_2)_m$, where $m$ is an integer of 1 to 6;

$X^-$ is a halogen ion, $HSO_4^-$, $HSO_3^-$, $HCOO^-$, or $CH_3COO^-$;

$n$ is an integer such that the number average; molecular weight becomes 2,000 to 350,000; and, $a$ and $b$ are natural numbers having a relation such that $a : b = 10$; (10 to 100).

This polyamine sulfone is known and is disclosed in Japanese Patent Publication Nos. 37033/1970 and 343/1970.

Of the polyamine sulfones of this character, those of a degree of polymerization such that the number average molecular weight is 2,000 to 350,000 are effective when used in the zinc plating method of the invention. If the number average molecular weight is less than 2,000, difficulties will be encountered in producing the polyamine sulfone, which therefore will be difficult to secure. On the other hand, if this number average molecular weight exceeds 350,000, the zinc plating film will become hard and will be difficult to work.

In addition, with the increase in $b$, that is, the molar number of $SO_2$, a zinc plating film having an excellent surface luster is obtained, but since the production of polyamine sulfone in excess of $a : b = 100 : 100$ is difficult, the maximum limit of $b$ was set at 100 for $a = 100$. Furthermore, the quality of the zinc plating film becomes inferior when $b$ is less than 10 for $a = 100$. Thus the molar number of $SO_2$ is important. Preferably $b$ is 40 or more for $a = 100$.

It is apparent that from this that the quantity of the polyamine sulfone added differs with factors such as the alkaline zinc plating bath into which this polyamine sulfone is to be added, the kind of polyamine sulfone, and the characteristic of the required zinc plating film. In general, in the case where an alkaline zinc plating bath of sodium zincate and sodium hydroxide is used, this added quantity should be in the range of 1 to 10 grams/liter. For example, this added quantity is suitably of the order of 3 grams/liter (g./1.) in the case of a polyamine sulfone of the following structural formula.

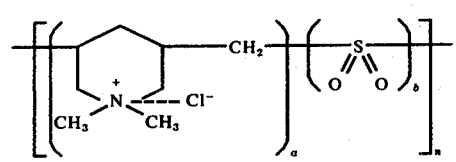

While the brightness of the plating film will become better with increasing added quantity of the polyamine sulfone, the hardness will increase, and the workability will become poor. On the other hand, if the added quantity of the polyamine sulfone is too small, the objects of this invention cannot be achieved.

An aromatic aldehyde capable of coexisting in mixed state as desired with this brightener is added together with the polyamine sulfone for the purpose of improving the brightness of the plating film. By using this aromatic aldehyde in mixed state with the polyamine sulfone, the brightness of the plating film can be improved over that obtainable through the use of the polyamine sulfone alone. The quantity added of this aromatic aldehyde varies depending on factors such as the kind of aromatic aldehyde and the required degree of brightness of the plating film. In general, an increase in this added quantity results in an improvement of the brightness of the plating film. As one example, an added quantity of methoxybenzaldehyde in the range of 0.1 to 0.5 g./l. is sufficient.

Examples of aromatic aldehydes suitable for use in the method according to the invention are as follows.

o-hydroxybenzaldehyde
m-hydroxybenzaldehyde
p-hydroxybenzaldehyde
3,4-dimethoxybenzaldehyde
3,4-methylenedioxybenzaldehyde
methoxybenzaldehyde
aminobenzaldehyde
4-hydroxy-3-methoxybenzaldehyde
3-hydroxy-4-methoxybenzaldehyde
3-methoxysalicylaldehyde
cinnamaldehyde
toluic aldehyde It will be apparent that the aromatic aldehydes which can be used in the method of this invention are not restricted to those listed above. Fundamentally, there is no restriction on the nature of the zinc plating bath into which the polyamine sulfone of the invention is to be added provided that it is an alkaline bath in which zinc in a soluble state is dispersed. For example, this bath can be a solution comprising zinc sulfide and sodium hydroxide. This solution is a solution wherein zinc is dispersed in the form of sodium zincate.

While the number average molecular weight of the polyamine sulfone is in the wide range of 2,000 to 350,000, as mentioned hereinbefore, there is tendency for the degree of polymerization to decrease in an alkaline aqueous solution. In general, however, the number average molecular weight does not decrease below 2,000 in a sodium hydroxide solution of a concentration of 200 g./l.

The plating conditions for zinc plating in a plating bath of this character can be the same as those for zinc plating in an ordinary alkaline plating bath containing a cyanic compound. It is also possible to use the plating operation and plating equipment used conventionally. For example, with the Hull cell testing method, a zinc plating film of high brightness is obtained in the range of current density of 0.05 to 27 A/dm$^2$. The optimum range is 0.1 to 6 A/dm$^2$.

The temperature of the plating bath in the case of a bath containing a cyanic compound cannot be permitted to exceed approximately 30° to 35° C. Moreover, with a current density below 1 A/dm$^2$., a gray plating film without any brightness whatsoever is formed. The reason for this is that the organic brightener decomposes. However, since the polyamine sulfone does not decompose even at a temperature above 40° C, it has the advantage of performing effectively even when the plating bath temperature is above 40° C. Accordingly, there is little necessity of providing the plating equipment with a cooling device.

In order to indicate more fully the nature and utility of this invention, the following examples of practice constituting preferred embodiments of the invention are set forth, it being understood that these examples are presented as illustrative only and that they are not intended to limit the scope of the invention.

EXAMPLE 1

A plating bath of the following composition was prepared

| | |
|---|---|
| ZnO | 14.2 g/l |
| NaOH | 130 g/l |

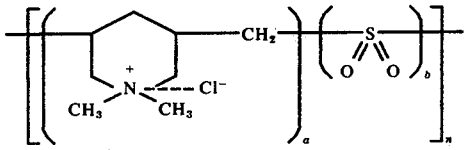

a:b = 100:70
Number average molecular weight 2,000, approx.
methoxybenzaldehyde 0.5 g/l This plating bath was used to carry out plating with a Hull cell tester. A steel plate was plated at a plating temperature in a range of 25° to 28° C without agitation for 10 minutes with a total current of 2A.

As a result, zinc plating of excellent brightness was obtained over a wide range of current density of 0.05 to 15 A/dm$^2$. Similarly, a bright zinc plating was obtained over the entire surface of the Hull cell plate when plating was carried out similarly with a total current of 1 A for 10 minutes.

EXAMPLE 2

A plating bath of the following composition was prepared.

| | |
|---|---|
| ZnO | 14.2 g/l |
| NaOH | 130 g/l |

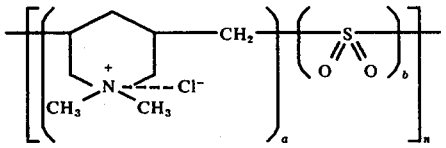

3 g/l a:b = 100:70
Number average molecular weight 2,000, approx.
3,4-methylenedioxybenzaldehyde 0.5 g/l This plating bath was used to carry out plating with a Hull cell tester. A steel plate was plated at a plating temperature in a range of 25° to 28° C without agitation for 10 minutes with a total current of 2A.

As a result, bright plating was obtained with a current density over a range of 2 to 15 A/dm$^2$., while semi-bright plating was obtained over 0.05 to 2 A/dm$^2$.

EXAMPLE 3

A plating bath of the following composition was prepared.

| | |
|---|---|
| ZnO | 14.2 g/l |
| NaOH | 130 g/l |

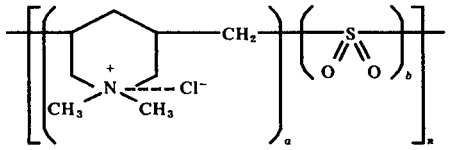

3 g/l

-continued

| | |
|---|---|
| a:b = 100:70<br>Number average molecular<br>weight 2,000, approx.<br>3,4-dimethoxybenzaldehyde | 1 g/l |

This plating was used to carry out plating with a Hull cell tester. A steel plate was plated at a plating temperature in a range of 25° to 28° C without agitation for 10 minutes with a total current of 2A.

As a result, bright plating film was obtained with a current density over a range of 1 to 15 A/dm$^2$., while semi-bright plating film was obtained over a range of 0.2 to 1 A/dm$^2$. At a current density below 0.2 A/dm$^2$., a gray plating surface was obtained.

EXAMPLE 4

A plating bath of the following composition was prepared.

| | |
|---|---|
| ZnO<br>NaOH | 16.4 g./l.<br>150 g./l. |
| 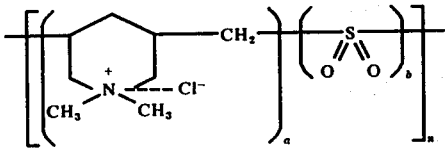 | 3 g./l. |
| a:b = 100:70<br>Number average molecular<br>weight 2,000 approx.<br>p-hydroxybenzaldehyde | 0.5 g./l. |

This plating bath was used to carry out plating with a Hull cell tester Steel plates were plated at a plating temperature in a range of 25° to 28° C without agitation for 10 minutes respectively with total currents of 1A and 2A.

As a result, a bright zinc plating film was obtained in a range of current density of 0.05 to 7.5 A/dm$^2$. in the case of plating for 10 minutes with 1A, while a zinc plating film of excellent brightness over the entire surface thereof was obtained in the case of plating for 10 minutes with 2A.

With the use of a zinc plating bath as specified in Example 1 except for the use of 0.5 g./l. of p-hydroxybenzaldehyde instead of methoxybenzaldehyde, a Hull cell test was carried out under the conditions set forth above, whereupon a bright plating film was obtained.

EXAMPLE 5

A plating bath of the following composition was prepared.

| | |
|---|---|
| ZnO<br>NaOH | 14.2 g./l.<br>130 g./l. |
| 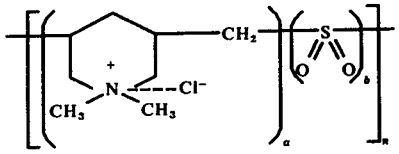 | 3 g.l. |
| a:b = 100:70<br>Number average molecular<br>Weight 2,000, approx.<br>m-hydroxybenzaldehyde | 0.5 g.l. |

This plating bath was used to carry out plating with a Hull cell tester. A steel plate was plated at a plating temperature in a range of 25° to 28° C without agitation for 10 minutes with a total current of 2A.

As a result, a zinc plating film which was bright over its entire surface was obtained. However, minute pitting occurred at current densities in the range of 4 to 15 A./dm$^2$.

EXAMPLE 6

A plating bath of the following composition was prepared.

| | |
|---|---|
| ZnO<br>NaOH | 14.2 g./l.<br>130 g./l. |
| 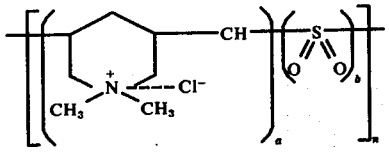 | 3 g./l. |
| a:b = 100:70<br>Number average molecular<br>Weight 2,000, approx.<br>9-hydroxybenzaldehyde | 0.25 g./l. |

With the use of this plating bath, plating was carried out with a Hull cell tester. A steel plate was plated at a plating temperature in a range of 25° to 28° C without agitation for 10 minutes with a total current of 2A.

As a result, bright plating was obtained in the range of 3.5 to 15 A./dm.$^2$, and semi-bright plating was obtained in the range of 0.2 to 3.5 A./dm$^2$. Below 0.2 A/dm$^2$., slightly inferior semi-brightness was obtained.

Even when the concentration of the o-hydroxybenzaldehyde was increased to 0.5 g./l., the only change was that the high current side above 8 A./dm$^2$. acquired an extremely bright appearance.

EXAMPLE 7

A plating bath of the following composition was prepared.

| | |
|---|---|
| ZnO<br>NaOH | 14.2 g./l.<br>130 g./l. |
| 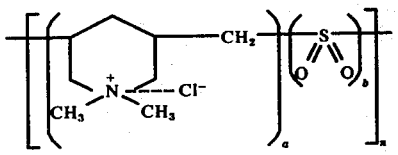 | 3 g./l. |
| a:b = 100:70<br>Number average molecular<br>weight 300,000, approx.<br>methoxybenzaldehyde | 0.5 g./l. |

This plating bath was used to carry out plating by means of a Hull cell tester. A steel plate was plated at a plating temperature in a range of 25° to 28° C without agitation for 10 minutes with a total current of 2A.

As a result, the plating surface exhibited an exceptionally good brightness in a current density range of 0.05 to 27 A/dm$^2$. Similarly as in Example 1. semi-brightness was exhiibited at current densities less than 0.05 A/dm$^2$. However, since the number average molecular weight was of a high value of 300,000, there was a tendency of the deposited zinc film to become hard.

EXAMPLE 8

A plating bath of the following composition was prepared.

| | |
|---|---|
| ZnO | 10.9 g./l. |
| NaOH | 100 g./l. |
| 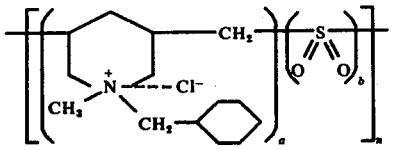 | 3 g./l. |
| a:b = 100:70<br>Number average molecular weight 5,000<br>methoxybenzaldehyde | 0.5 g./l. |

This plating bath was used to carry out plating by means of a Hull cell tester. A steel plate was plated at a plating temperature in a range of 25° to 28° C without agitation for 10 minutes with a total current of 2A.

As a result, a sponge-like deposition was obtained in a range of current density of 10 to 27 A/dm$^2$., while a bright surface was obtained at 2 to 10 A/dm$^2$. A semi-bright surface was obtained at current densities less than 2 A/cm$^2$.

The polyamine sulfone used in this example has a tendency to undergo a lowering of its number average molecular weight in an aqueous solution of NaOH. However, this molecular weight does not become lower than 2,000.

EXAMPLE 9

A plating bath of the following composition was prepared.

| | |
|---|---|
| ZnO | 21.8 g./l. |
| NaOH | 200 g./l. |
| 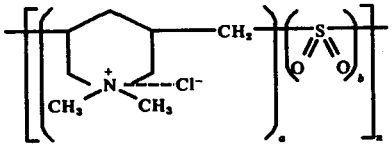 | 3 g./l. |
| a:b = 100:70<br>Number average molecular weight 2,000, approx.<br>aminobenzaldehyde | 0.5 g./l. |

This plating bath was used to carry out plating by means of a Hull cell tester. A steel plate was plated at a plating temperature of 35° to 40° C without agitation for 10 minutes with a total current of 2A.

As a result, a bright plating film similar to that of Example 1 was obtained.

EXAMPLE 10

A plating bath of the following composition was prepared.

| | |
|---|---|
| ZnO | 14.2 g./l. |
| NaOH | 130 g./l. |
| 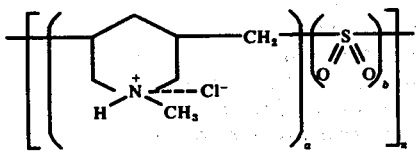 | 3 g./l. |

-continued

| | |
|---|---|
| a:b = 100:70<br>Number average molecular weight 5,000<br>methoxybenzaldehyde | 0.5 g./l. |

This plating bath was used in a Hull cell tester to plate a steel plate at a plating temperature in a range of 25° to 28° C without agitation for 10 minutes with a total current 2A.

As a result, a semi-bright plating film was obtained in a current density range of 10 to 27 A./dm$^2$. A bright film over the entire surface thereof was obtained at current densities less than 10 A./dm$^2$.

EXAMPLE 11

A plating bath of the following composition was prepared.

| | |
|---|---|
| ZnO | 14.2 g./l. |
| NaOH | 130 g./l. |
| 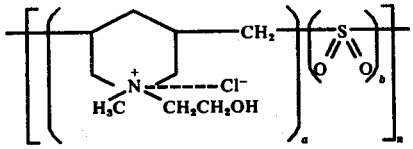 | 3 g./l. |
| a:b = 100:70<br>Number average molecular weight 5,000<br>methoxybenzaldehyde | 0.5 g./l. |

This plating bath was used in a Hull cell tester to plate a steel plate at a plating temperature in a range of 25° to 28° C without agitation for 10 minutes with a total current of 2A.

As a result, a bright plating over the entire surface thereof was obtained at current densities above 5 A./dm$^2$., below which the brightness was slightly inferior.

Furthermore, plating was carried out under the conditions set forth above except that the plating temperature was raised to a range of 35° to 40° C, whereupon a bright plating film was obtained at current densities above 7 A/dm$^2$., while other surfaces were semi-bright.

EXAMPLE 12

A plating bath of the following composition was prepared.

| | |
|---|---|
| ZnO | 16.4 g./l. |
| NaOH | 150 g./l. |
| 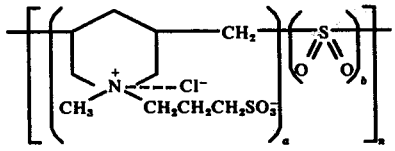 | 3 g./l. |
| a:b = 100:70<br>Number average molecular weight 5,000<br>methoxybenzaldehyde | 0.5 g./l. |

This plating bath was used in conjunction with a Hull cell tester to plate a steel plate at a plating temperature of 25° to 28° C without agitation for 10 minutes with a total current of 2A.

As a result, a spongy zinc plating was deposited at current densities above 10 A./dm$^2$., but at current densities less than 10 A./dm$^2$., plating was carried out under the conditions set forth above with a plating composition for semi-brightness. In this case, semi-brightness was obtained at current densities above 10A./dm$^2$., while slight brightness was obtained at current densities less than 10 A./dm$^2$.

EXAMPLE 13

Plating films were formed respectively by using a plating bath containing sodium cyanide, a conventional plating bath not containing sodium cyanide, and a plating bath according to this invention.

A corrosion resistance test was carried out on each of the plating films thus formed, the test being a salt-water spray test in accordance with Japan Industrial Standards, JIS Z2371.

The compositions of the plating baths were respectively as follows.

The polyamide sulfone used in the following bath has a ratio a:b of 100:70.

Table 1.

| Composition | Bath No. 1 | 2 | 3 | 4 |
|---|---|---|---|---|
| | unit (g/l) | | | |
| ZnO | 15 | | 42.0 | 16.4 |
| NaOH | 130 | 90 | 75.0 | 100 |
| NaCN | | 40 | 82.5 | |
| $Zn(CN)_2$ | | 60 | | |
| $Na_2CO_3$ | | 80 | | |
| $Na_2S$ | | 1 | | |
| 1-benzyl 3-carbinol-rubidium chloride | | 0.8 | | |
| poly(vinyl alcohol) (number average molecular weight 5,000, approx.) | | 0.13 | | |
| N-benzyl 3-methyl-carboxylatepyridinium chloride | | | 0.35 | |
| Polyamine sulfone ($R_1 = R_2 = CH_3$ X = Cl number average molecular weight 2,000, approx.) | 3 | | | |
| methoxybenzaldehyde reaction product of | 0.5 | | | |
| monoethanolamine and epichlorohydrin | | | | 5 |
| reaction product of hexamethylenetetramine and epichlorohydrin | | | | 5 |
| triethanolamine | | | | 100 |

Figure 2:
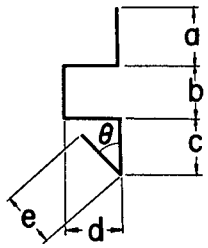
FIG. 2 is a sectional view of a test piece used in Example 13 set forth hereinafter, characters $a$, $b$, $c$, $d$, and $e$ designating respective dimensions, and $\theta$ designating an angle.

Plating was carried out with the above described plating baths 1,2, and 4 in a plating apparatus as shown in FIG. 1 with a bent cathode as shown in FIG. 2. This bent cathode was made of a steel sheet of a thickness of 0.3 mm., a width of 28 mm., and dimensions $a=b=c=d=$ 30 mm., the angle $\theta$ being 45°. The plating conditions were as follows.

| | | |
|---|---|---|
| Distance between Zn anode and cathode: | | 15 cm. |
| Total current: | | 3 A |
| Time: | Baths 1 and 2 | 15 min. |
| | Bath 4 | 20 min. |

-continued

| | |
|---|---|
| Plating film thickness: | 8 $\mu$. |

The plating films thus formed were washed with water, immersed in a 1-percent nitric acid solution, treated by immersing for 10 seconds in a yellow chromate of the composition set forth below, and thereafter dried.

| Yellow chromate | |
|---|---|
| $CrO_3$ | 200 g./l. |
| $H_2SO_4$ | 10 g./l. |
| $HNO_3$ | 1 g./l. |

The plating films thus treated were subjected to a salt-water test, whereupon the results shown in Table 2 were obtained, Table 2.

| Test specimen | Bath No. 1 | 2 | 4 |
|---|---|---|---|
| A | 264 hrs. | 216 hrs. | 240 hrs. |
| B | 264 " | 240 " | 264 " |
| C | 216 " | 216 " | 264 " |

The time (hrs.) in Table 2 is the elapsed time in hours at which corrosion occurs even in a single spot of a specimen.

EXAMPLE 14

By using the plating baths 1, 2, 3, and 4 in Table 1, respective steel plates measuring 100 × 66 mm. were plated under the conditions Specified in Example 13.

The brightnesses of the plating films thus formed were measure in accordance with Japanese Industrial Standards JIS Z 8741, method 2, 60° mirror surface brightness, whereupon the results set forth in the following Table 3 were obtained.

Table 3.

| Bath No.: | | 1 | | | 2 | | | 3 | | | 4 | | |
|---|---|---|---|---|---|---|---|---|---|---|---|---|---|
| Measurement position | Test specimen | A | B | C | A | B | C | A | B | C | A | B | C |
| 2 cm | | 527 | 574 | 560 | 556 | 579 | 563 | 492 | 505 | 509 | 138 | 132 | 218 |
| 5 cm | | 515 | 582 | 576 | 563 | 594 | 574 | 505 | 505 | 510 | 247 | 225 | 374 |
| 8 cm | | 525 | 568 | 579 | 576 | 602 | 554 | 505 | 504 | 503 | 267 | 189 | 190 |

These results indicate that a plating film formed by using the plating bath 1 of this invention exhibits a brightness equal to or greater than that of a plating film formed by using a plating bath (2 or 3) containing a cyanic compound, and, furthermore, is very good in comparison with that of a plating film formed with a conventional plating bath 4 not containing a cyanic compound.

EXAMPLE 15

In zinc plating, the plating rate is extremely important. The reason for this is that it is advantageous for productivity to obtain the required zinc plating film within a short time. By the conventional zinc plating process using a plating bath containing sodium cyanide, the deposition rate is of the order of 1 micron/minute with a current density of approximately 4 A./dm$^2$., but in a plating bath not containing a cyanic compound, the deposition rate tends to be slower than this.

The rate of deposition of plating film was measured in plating with the use of the plating bath 1 of this invention and conventional plating baths 2 and 4 by taking the Hull cell distribution.

The Hull cell conditions were as follows.

| | |
|---|---|
| Liquid quantity | 267 ml. |
| Total current | 2 A. |
| Plating time | 5 min. |
| Plating bath temperature | 25° C |

The thicknesses of the plating films thus formed were respectively measured by a film thickness measuring instrument of electrolytic type of the Kocour Company. The results were as indicated in FIG. 3.

Figure 3:
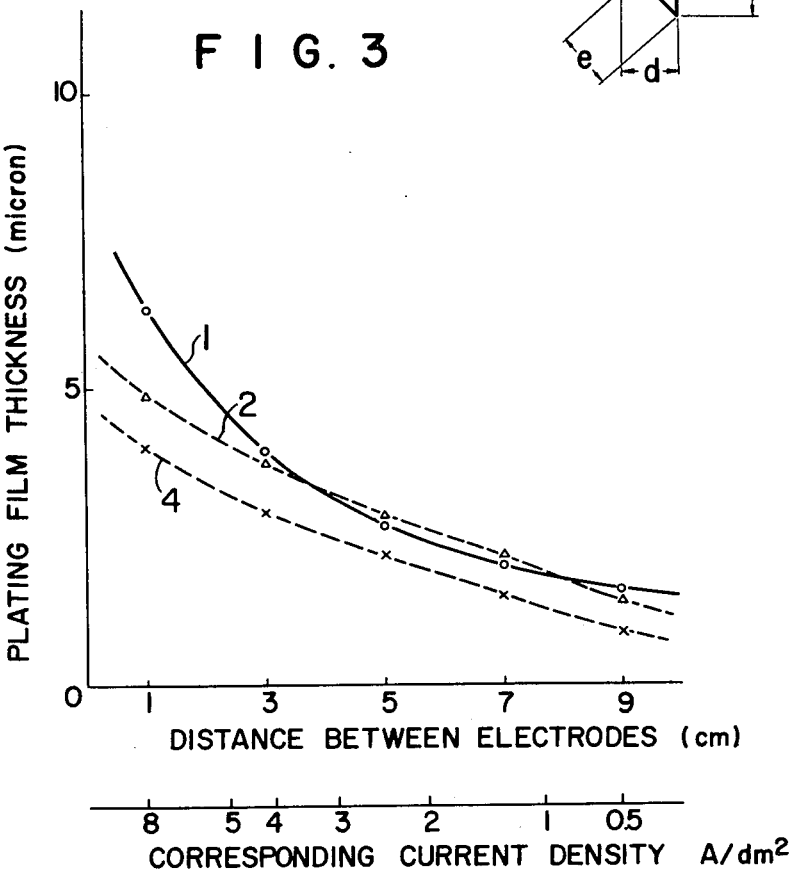
FIG. 3 is a graph indicating a comparison of rates of plating deposition measured in the case of the method of the present invention and that in the case of a conventional method.

In FIG. 3, the abscissa represents distance between electrodes, and the second abscissa axis therebelow represents current density (A./dm$^2$) corresponding to the distance (cm) between electrodes. The ordinate represents plating film thickness (micron).

The results shown in FIG. 3 indicate that, while the zinc film formed by plating with the use of the plating bath 2 indicated a deposition rate close to the standard rate, the deposition rate is very much inferior in the case where the plating bath 4 was used. This may be attributed to the large quantity in which the triethanolamine was added as a brightener, but if the quantity of the triethanolamine is reduced below this quantity, the brightness of the zinc plating film will be further reduced.

In the case where plating was carried out with the use of the plating bath 1 according to this invention, the deposition rate was equal to or superior to that in the case where the plating bath 2 was used.

In addition, by using the polyamine sulfone and methoxybenzaldehyde used in the plating bath 1 of this invention, plating baths 5 and 6 of the following compositions were newly prepared.

| Plating baths: | 5 | 6 |
|---|---|---|
| ZnO | 5.5 g./l. | 10.9 g./l. |
| NaOH | 130 g./l. | 130 g./l. |
| Polyamine sulfone ($R_1 = R_2 = CH_3$;X = Cl, number average molecular weight 2,000) | 3 g./l. | 3 g./l. |
| methoxybenzaldehyde | 0.5 g./l. | 0.5 g./l. |

By using these plating baths of different zinc concentrations, the deposition rates of zinc plating were measured under the same Hull cell conditions as those in the case of the preceding measurements.

Figure 4:
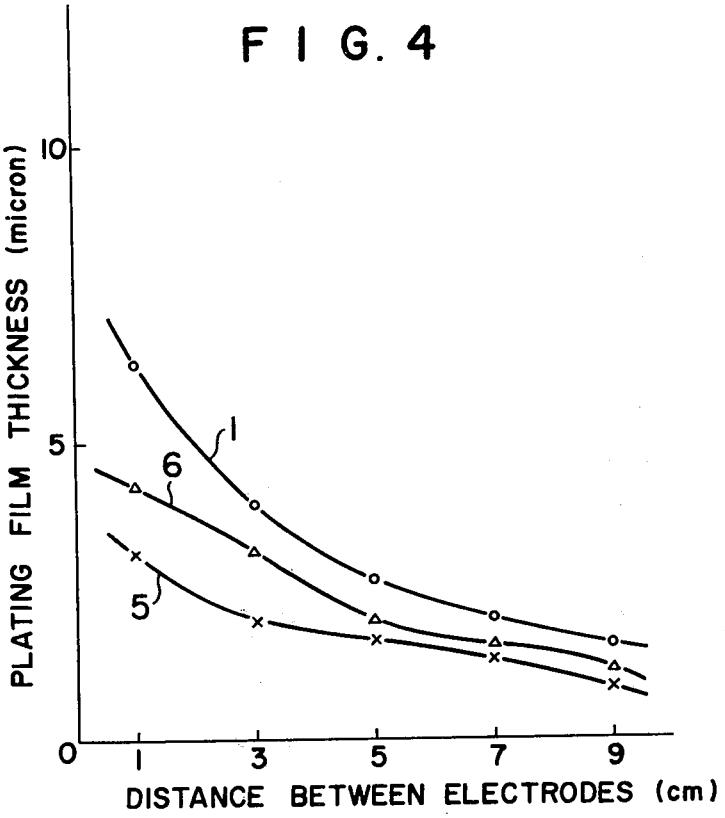
FIG. 4 is a similar graph indicating the variation of plating deposition rate with variation of zinc concentration.

The results are shown in FIG. 4, in which the coordinate axes respectively represent the same quantities as in FIG. 3.

It is apparent from these results that the zinc concentration in the plating bath is preferably greater than 10 g./l. (greater than 10.9 g./l. of ZnO).

EXAMPLE 16

Test specimens were prepared by forming zinc plating films of 8-micron thickness on the central parts of steel plates, each of 25-mm. width, 100-mm. length, and 1.0-mm. thickness, respectively by using plating baths 1, 2, and 3 under conditions equal to those set forth in Example 13.

These test specimens were bent and folded through 180° C in accordance with the bending test of Japanese Industrial Standards, JIS Z 2248, and the surface of the plated surfaces were examined for peeling under a magnifying glass of 15 × magnification. Prior to the plating, the surfaces of the steel plates were amply treated for removal of oils and fats and for activation. The results were as follows.

| Test specimen | Plating bath | 1 | 2 | 3 |
|---|---|---|---|---|
| a | | no peeling | no peeling | no peeling |
| b | | " | " | " |
| c | | " | " | " |

These results indicate that, with respect to the above described test, the plating film formed in accordance with this invention does not differ from that formed with the use of a plating bath containing a cyanic compound.

EXAMPLE 17

Figure 6:
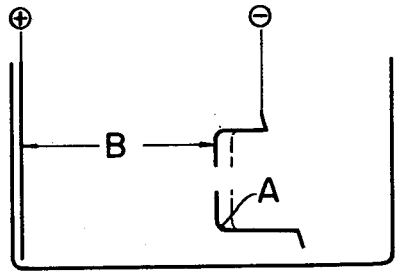
FIG. 6 is a diagrammatic sectional view showing a plating vessel used for plating a test piece used in Example 17.
Figure 5A:
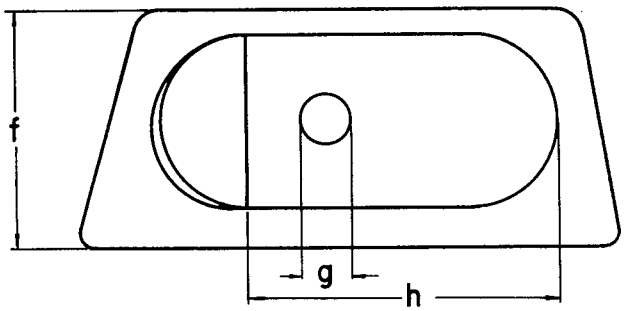
FIGS. 5(A), 5(B), and 5(C) are respectively mutually orthogonal views showing a test piece used in Example 17 set forth hereinafter.
Figure 5B:
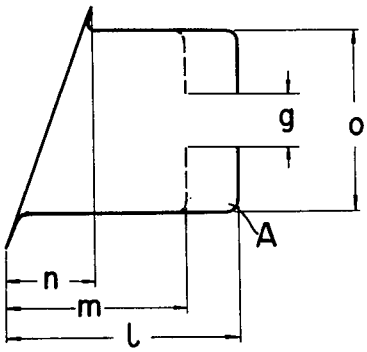
Figure 5C:
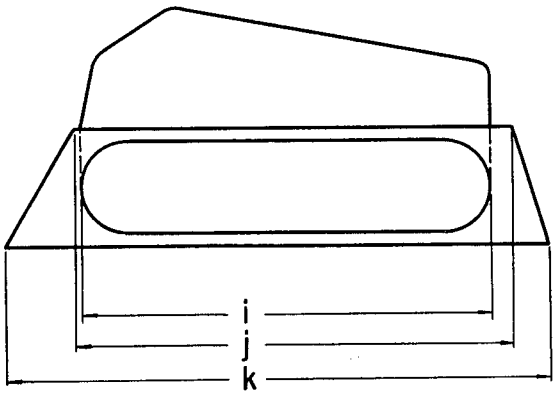

With the use of a plating bath prepared as specified in Example and an electrolytic vessel as shown in FIG. 6, a test piece as shown in FIG. 5 was plated. The various dimensions in FIG. 5 of this test piece were as follows (in mm.).

| | | |
|---|---|---|
| f : 80 | g : 22 (diam.) | h : 105 |
| i : 127 | j : 130 | k : 183 |
| n : 27 | m : 55 | l : 70 |
| o : 60 | | |

The plating was carried out with 10 liters of the plating bath liquid at 38° to 40° C a current density of 3 A./dm.$^2$ with respect to 5 dm$^2$ of the test piece (which was an automobile part), and a distance B between electrodes of 10 cm The entire surface of the resulting plated surface was bright. A particularly noteworthy result was that the parts A in FIGS. 5 and 6, which are ordinarily difficult to make bright, also exhibited brightness.

An identical test piece was placed by using the plating bath 3 in Table 1 under the same conditions as above, whereupon it was found that the parts A were semibright.

EXAMPLE 18

| | |
|---|---|
| ZnO | 14.2 g./l. |
| NaOH | 130 g./l. |

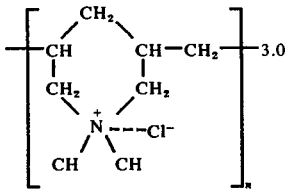

| | |
|---|---|
| Number average molecular weight 2,000 | |
| Methoxybenzaldehyde | 0.5 g./l. |

Through the use of the above indicated electrolytic bath, a steel plate was plated in a Hull cell tester at a plating liquid temperature ranging from 25° to 28° C, a total current of 2A, for 10 minutes, without agitation. A plating film obtained at a current density of 5A/dm² or more has a sandy, inferior surface, while that obtained below 5A/dm² also had a plating film devoid of luster. Accordingly, these lack is practicability.

Another steel plate was plated in the Hull cell tester by using the following electrolytic bath.

| | |
|---|---|
| ZnO | 14.2 g./l |
| NaOH | 130.0 g./l |
| 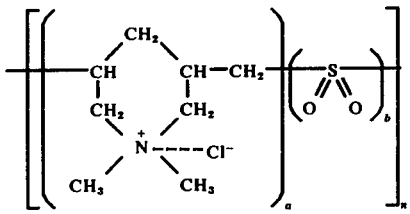 | 3.0 g./l. |
| Average molecular weight 2,000, a: 100 mol %, b: 10 mol % | |
| Methoxybenzaldehyde | 0.5 g./l. |

The plating was carried out at a plating liquid temperature ranging from 25° to 28° C, and a total current of 2 A/dm², for 10 minutes, without agitation.

Semi-brightness was obtained within a range from 10 to 27 A/dm², and full surface brightness was obtained below 10 A/dm².

EXAMPLE 19

| | |
|---|---|
| ZnO | 14.2 g./l. |
| NaOH | 13.0 g./l. |
| 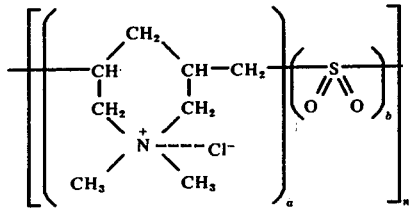 | 3.0 g./l. |
| a:100 mol %, b:40 mol % Average molecular weight 2,000 | |
| Methoxybenzaldehyde | 0.5 g./l. |

With a plating bath having the above composition, plating was carried out on a steel plate by using a Hull cell tester, at a plating liquid temperature ranging from 25° to 28° C, at a full current of 2A, for 10 minutes, without agitation. Semi-brightness was obtained within a range of current density above 15 A/dm², while full surface brightness was obtained at 10A/dm² or below.

EXAMPLE 20

| | |
|---|---|
| ZnO | 14.2 g./l. |
| NaOH | 130.0 g./l. |
| 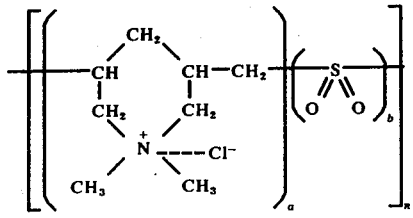 | 3.0 g./l. |
| a: 100 mol %, b:90 mol % Average molecular weight 2,000, | |

-continued

| | |
|---|---|
| Methoxybenzaldehyde | 0.5 g./l. |

With a plating bath having the above composition, plating was carried out on a steel plate by using a Hull cell tester, at a plating liquid temperature ranging from 25 to 28° C, with a full current of 2A, for 10 minutes, without agitation. Excellent brightness was obtained throughout the entire surface of the Hull cell steel plate.

EXAMPLE 21

| | |
|---|---|
| ZnO | 14.2 g./l. |
| NaOH | 130.0 g./l. |
| 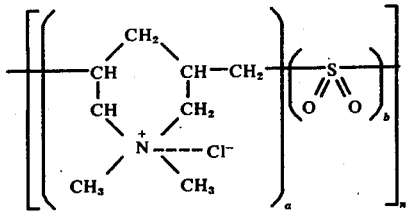 | 3.0 g./l. |
| a:100 mol %, b:100 mol %, Average molecular weight 2,000 | |
| Methoxybenzaldehyde | 0.5 g./l. |

With a plating bath having the above composition, plating was carried out on a steel plate by using a Hull cell tester, at a plating liquid temperature ranging from 25° to 28° C, with a full current of 2A, for 10 minutes, without agitation. As in the case of Example 20, a surface having excellent brightness was obtained all over the Hull cell steel plate. Particularly, an extremely superior brightness was obtained within a range of low current density, i.e., 1 A/dm² of below.

In general, zinc plating is subjected to a chromate treatment upon completion of the plating in order to improve its corrosion preventing property. During this chromate treatment process, the plate surface is further chemically polished, and for this reason, there is almost no problem even when the zinc plated surface after completion of the plating is semi-bright. Accordingly, in the case of zinc plating, the brightness of the plating surface is considerably increased in many cases by the characteristic of the chromate treatment liquid subsequently applied as long as the plating surface is at least semi-bright.

While the plating liquid temperature depends in part on the characteristic of the brightener used, the limiting temperature is of the order of 30° to 35° C in zinc plating with or without a cyanic compound. The reason for this is that, in the case of an alkaline bath at high temperature, most of the brighteners generally sold on the market tend to decompose readily. Consequently, the cost of the plating process increases as a result of a lowering of the brightness, an increase in the quantity of the brightner used, or like effect. In contrast, when the brightener of this invention in which a polyamine sulfone is the principal ingredient is used, ample brightness is obtained even with a plating liquid temperature of 40° C.

In general, in order to control temperature rise in the plating bath in plating plants and the like, a considerably large refrigeration plant or machine is installed. For example, in the case of operation without agitation with a zinc plating liquid quantity of 10,000 liters, a refrigerating machine of approximately 15 hp. is required. In contrast, there is almost no necessity for a refrigerating machine in the practice of this invention.

We claim:

1. In a zinc plating method which comprises carrying out electrodeposition in an aqueous alkaline zinc plating bath, the improvement comprising adding to said bath a brightening effective amount of an aromatic aldehyde and a polyamine sulfone represented by the formula

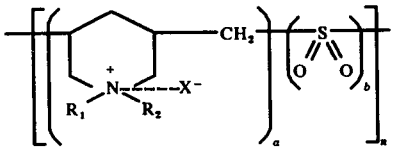

where: each of $R_1$ and $R_2$ is a member selected from the group consisting of hydrogen, an allyl group, straight-chain and branched-chain alkyl groups each having 1 to 16 carbon atoms, an aralkyl group, and hydroxyalkyl groups of the formula $HO\text{-}(CH_2)_m$, where $m$ is an integer of 1 to 6;

$X^-$ is a member selected from the group consisting of halogen ion, $HSO_4^-$, $HSO_3^-$, $HCOO^-$, and $CH_3COO^-$;

$n$ is an integer such that the number average molecular weight becomes 2,000 to 350,000; and a and b are natural numbers having a relation such that $a:b = 100:10$ to 100.

2. The zinc plating method as claimed in claim 1 in which said alkaline zinc plating bath comprises zonc oxide, sodium hydroxide, and water prior to the addition of said aromatic aldehyde and polyamine sulfone.

3. The zinc plating method as claimed in claim 1 in which said aromatic aldehyde is a member selected from the group consisting of O-hydroxybenzaldehyde, m-hydroxybenzaldehyde p-hydroxybenzaldehyde, 3,4-dimethoxybenzaldehyde, 3,4-methylenedioxybenzaldehyde, methoxybenzaldehyde, aminobenzaldehyde, 4-hydroxy-3-methoxybenzaldehyde, 3-hydroxy-4-methoxybenzaldehyde, 3-methoxysalicylaldehyde, cinnamaldehyde, and toluic aldehyde.

4. The zinc plating method as claimed in claim 1 in which said polyamine sulfone is a member having a formula selected from the group consisting of

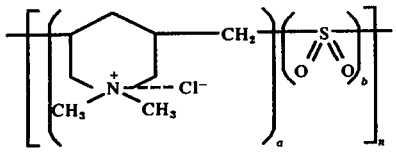

wherein $a:b$ is a ratio such that $a$ is 100 and $b$ is 10, 40, 70, 90 or 100, and n is an integer such that the average molecular weight is about 2000;

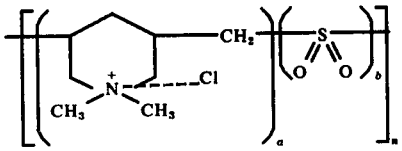

wherein $a:b = 100:70$, wherein $n$ is an integer such that the number average molecular weight is about 300000;

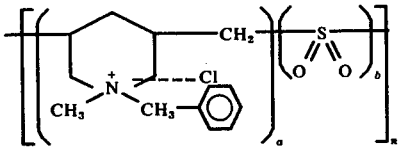

wherein $a:b = 100:70$, and $n$ is an integer such that the number average molecular weight is about 5000

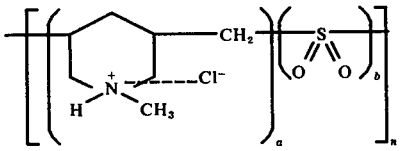

wherein $a:b = 100:70$, and $n$ is an integer such that the number average molecular weight is about 5000

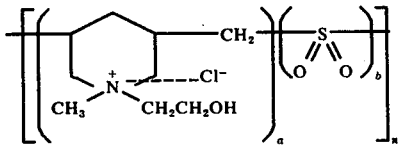

wherein $a:b = 100:70$, and $n$ is an integer such that the number average molecular weight is about 5000, and

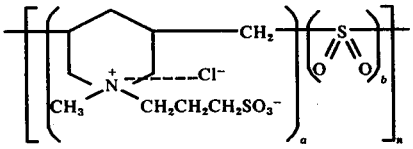

wherein $a:b = 100:70$, and $n$ is an integer such that the number average molecular weight is about 5000.

5. The zinc plating method as claimed in claim 1 in which the quantity of the polyamine sulfone added is about 1 to 10 grams per liter of the bath.

6. The zinc plating method as claimed in claim 5 in which the quantity of the aromatic aldehyde is about 0.1 to 1 gram per liter of the bath.

* * * * *